United States Patent [19]

Monroe

[11] Patent Number: 4,827,647

[45] Date of Patent: May 9, 1989

[54] SIGN DISPLAY SUPPORT APPARATUS

[76] Inventor: Mathis Monroe, 1336 N. Austin Blvd., Oak Park, Ill. 60302

[21] Appl. No.: 111,609

[22] Filed: Oct. 23, 1987

[51] Int. Cl.[4] ..... G09F 7/18

[52] U.S. Cl. ..... 40/603; 40/153; 160/378

[58] Field of Search ..... 40/153, 155, 603, 604; 38/102.1, 102.91; 160/374.1, 378; 69/19.1, 19.2, 19.3

[56] References Cited

U.S. PATENT DOCUMENTS

| | | | |
|---|---|---|---|
| 473,706 | 4/1892 | Martyn | 40/153 |
| 2,803,086 | 8/1957 | Ross | 38/102.1 |
| 4,028,832 | 6/1977 | Wu | 40/155 |
| 4,210,191 | 7/1980 | Li | 160/378 X |

*Primary Examiner*—Robert P. Swiatek

*Attorney, Agent, or Firm*—Richard C. Litman

[57] ABSTRACT

A signing display support apparatus utilizing a fastening element at the corners of a frame member, the fastening element having a connector element, preferably of elastic material, that is affixed diagonally to a non-elastic securing element. The securing element has a member for cinching up a stiffening element that retains a wire element therethrough. As four or more of the fastening elements are deployed peripherally around the interior of a frame member, the wire element is deployed through the stiffening elements and the positioning of the stiffening elements is determined by the selectable length of the securing elements.

7 Claims, 3 Drawing Sheets

SIGN DISPLAY SUPPORT APPARATUS

FIELD OF INVENTION

This invention relates to signs and, more particularly to an apparatus for supporting sign elements within a frame member. Specifically, this invention teaches the construction of an apparatus for the suspension of electrified sign elements within the area of a frame member.

BACKGROUND TO THE INVENTION

Sign materials are typically fitted to a frame and quite often the frame itself may be purchased to accommodate a slightly larger or smaller display. This is because the clips or fastening means have no adjustment and cannot materially accomodate a larger or smaller display within the frame.

Fitting a display to a frame member is more complicated if the display is electrified, as with an array of lights in a grid to spell out or outline a display figures; the wiring should be hidden from view and the lighting elements themselves supported within the display. Moreover, as indicated, special frames must often be built to insure a proper sizing of display within the frame member.

The present invention relates to a means for supporting electrified lighting element and to allow their arrangement and subsequent display within a frame member while concurrently hiding or camouflaging the wiring thereof as well as the support means to the display.

This invention further relates to a means for varying the size of the display support mechanism thereby allowing many different sizes of displays to be supported within a given frame member area.

This invention also relates to a means for fastening a display support means to a frame member and for providing mechanical and magnetic means for adhering the support structure to the frame or other suitable mounting surfaces.

DESCRIPTION OF THE PRIOR ART

The following cited references are considered to be exemplary of the U.S. prior art. They are:

| | Inventor |
|---|---|
| U.S. Pat. No. | |
| 3,702,033 | Coleman |
| 2,499,731 | Derington |
| 2,154,088 | Guba |
| Design Patent Nos. | |
| 1,959,936 | Escalante |
| 241,282 | Mihojevich |

U.S. Pat. No. 3,702,033, issued to Coleman, discloses a display device having arrangements of lights both in the interior and exterior of the frame.

U.S. Pat. No. 2,499,731, issued to Derington, discloses a translucent sheet of material secured in position over a window to display Christmas greetings or decorations.

U.S. Pat. No. 2,154,088, to Guba discloses an arrangement of illuminating elements or electric lamps upon a support to form an advertising message.

U.S. Pat. No. Des. 1,9959,936, issued to Escalante and Des. b 241,282 to Mihojevich, discloses ornamental designs for illuminated display signs. None of the above cited references, taken singularly or in combination disclose the specific construction of the present invention in any way so as to bear upon the claims as appended hereto.

SUMMARY OF THE INVENTION

An object of the present invention is to provide means for adapting the size of an illuminated display to the size of a frame member, to position, align and expand or contract the arrayed lighting elements to fit the size or area available within a frame member.

Another object of the invention is to provide fastening means to affix the apparatus to any suitable mounting surface such as a frame member and further to provide a variety of adhering means, such as threaded fasteners, VELCRO or magnetized means of attaching the signing display apparatus to a mounting surface.

Another object of the sign display apparatus is to provide means for guiding or aligning a wire filament element to selectively tighten or loosen the filament as needed for any individual sign element display.

DESCRIPTION OF THE PREFERRED EMBODIMENT

Figure 1:
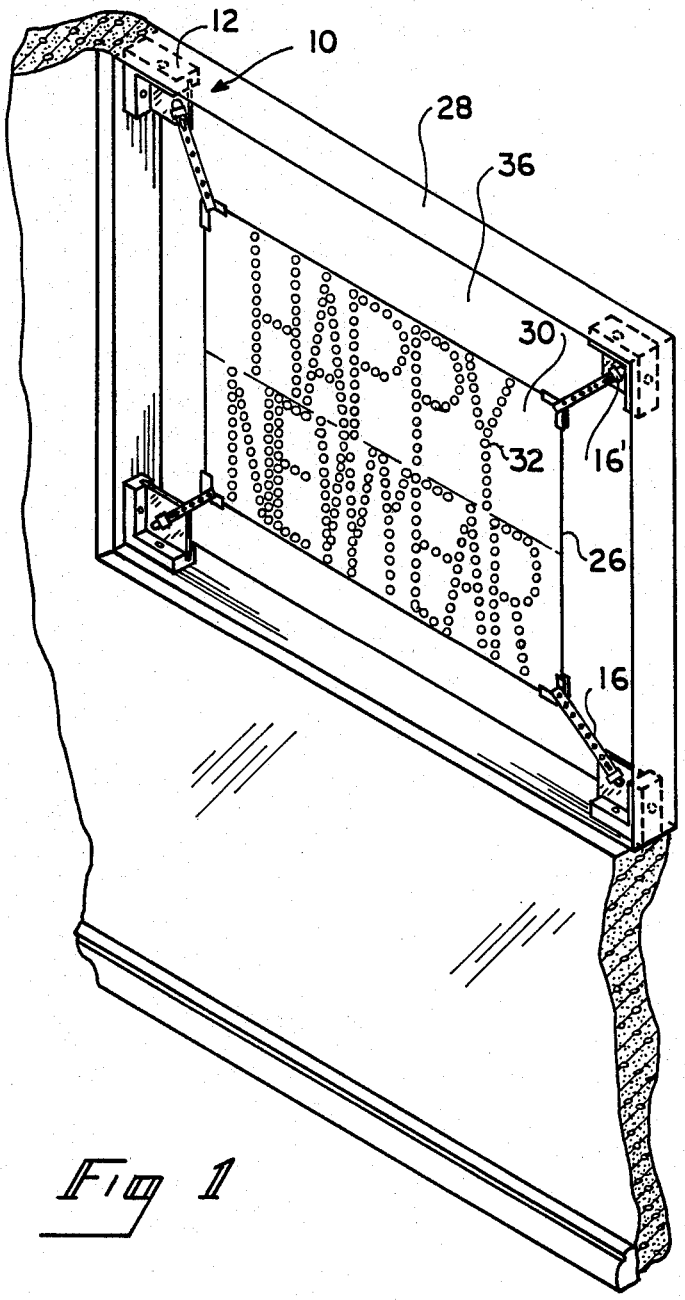
FIG. 1 is a perspective view of the sign display support apparatus in use and illustrates a lighting sign display deployed behind a frosted glass or translucent pane and supported by the adjustable corner mounted fastening means.
Figure 2:
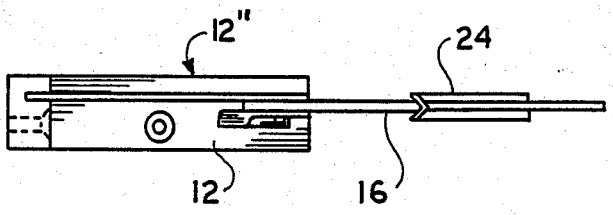
FIG. 2 is a side view of one of the fastening means that shows a connector element rigidly affixed to a fastener support.
Figure 3:
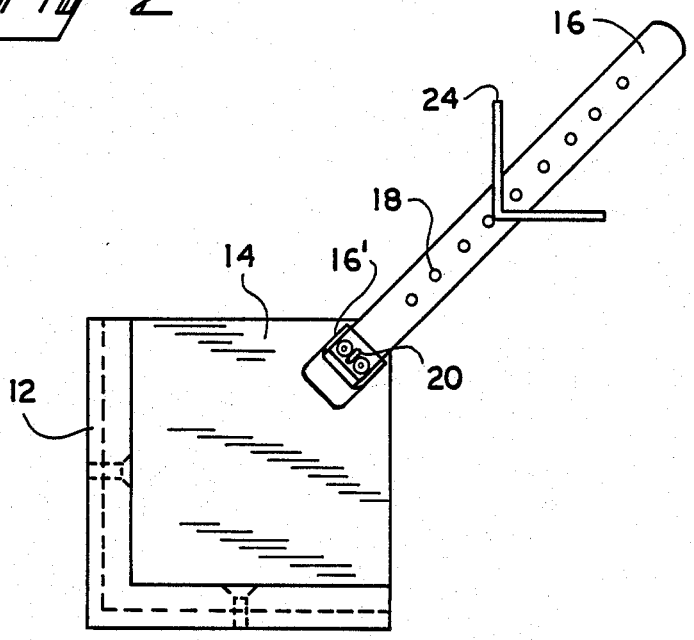
FIG. 3 is a top view of the sign display support fastening means that illustrates a fastener support bracket, a connector element and a securing strap means extending outwardly therefrom.
Figure 4:
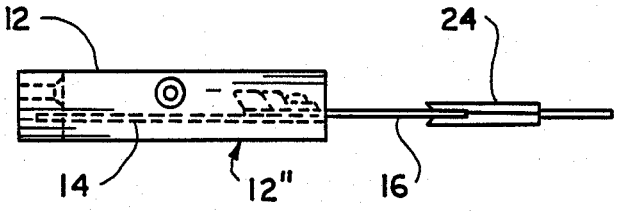
FIG. 4 is another side view illustrating the L-shaped fastener bracket and showing the connector elements as affixed therein.
Figure 5:
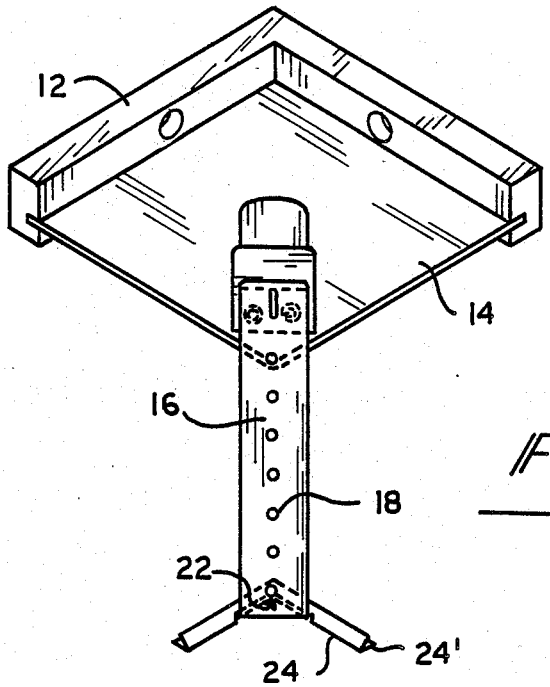
FIG. 5 is a perspective view of the sign display support apparatus shows a stiffening element slidably deployed on the length of the securing element to hold a wire therethrough and to suspend same.
Figure 6:
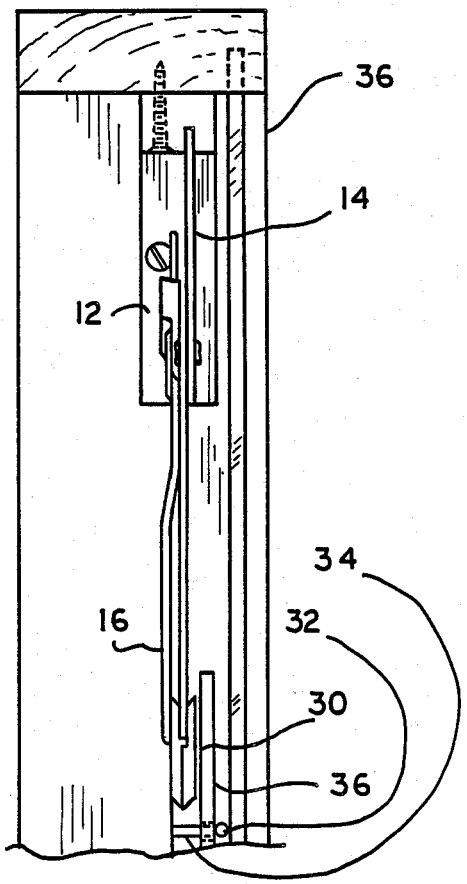
FIG. 6 is a elevational view illustrating the sign display support apparatus as installed in a frame member.

Reference is now made to the drawing in which like numerals relate to like elements throughout. The sign display support apparatus includes fastening means 12, such as an angle bracket to fit within a corner of a frame member 28. Fastening means 12 may, optionally have a magnetized strip (not shown) affixed to lower surface 12", or VELCRO strip affixed thereto to supplemental adhere fastening means 12 to any suitable mounting surface where threaded fastening are inappropriate.

A connector element 14 is removably affixed to the fastening means 12 and is constructed of any suitable pliable, preferably elastic material. Connector element 14 attaches to fastening means 12 by a recess. Connector element 14 is removable from fastening means 12 so as to allow the connector element 14 to be slidably removed from fastening means 12.

Fastening means 12 has a plurality of apertures therethrough for the insertion of threaded screws to affix fastening means 12 to a frame member or other suitable mounting surface and further may be magnetized to provide still another method of attachment.

Connector element 14 has attached thereto securing element 16 that extends substantially diagonally outward from connector element 14. Securing element 16 has a non-elastic construction of any suitable, preferably transparent material; the linear extension of non-elastic securing element 16 distributes any coefficient of loading to the elastic properties of connector element 14 to provide thereby a stable support platform that yet absorbs vibrations and impacts on the display; the loading coefficient being distributed through connector element 14 directly to fastening means 12.

Securing element 16 has cinching means 18 such as a hook and loop construction to draw up and secure in the open terminal end 16' of securing element 16. Stiffening element 24 is slidably deployed along the length of securing element 16; stiffening element 24 being substantially centered on securing element 16 and transversely deployed thereto.

Stiffening element 24 is configured to accept a wire element therethrough and has a vee-configuration 24' providing a guideway recess that effectively guides a wire element through apex 22 to contain and direct a wire element 26 through the sign display support apparatus. The apparatus, containing the wire element 26 allows the wire element 26 to be slidably adjusted within the frame member 28.

Wire element 26 defines a peripheral configuration within frame member 28 as the wire or filament element 26 is deployed or strung through a plurality of corner mounted fastening means 12.

The area or size of the area of this peripheral wire configuration is regulated by recourse to securing element 16, that adjusts the net effective length of stiffening element 24 into or away from its respective fastening means 12.

As securing element 16 is lengthened or shortened, the stiffening element 24 and its captive wire or filament element 26 is drawn in closer or conversely is disposed outwardly to increase the net size of a display area as defined by the periphery configuration of the filament element 26.

Sign elements 32 may be electrified, the wires to same being hidden or camouflaged behind support element 30, which is a translucent sheeting material placed within frame member 28; the translucent quality of the glass visually disguising the base or plugs of the lighting elements 32. A matte frame 36 adds yet another element of visual appeal to the sign material by hiding any visual reference to the wire element or support means.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents, which may be resorted to, fall within the scope of the invention.

What is claimed is:

1. A sign display support apparatus, comprising:

fastening means having a connector element comprising an elastic material, rigidly affixed thereto, said connector element having a securing element comprising a non-elastic material extending therefrom, said securing element having a means for engaging a stiffening element, said fastening means being deployed on a periphery of a frame member, said stiffening element being disposed inwardly of said frame member, said stiffening element surrounding a wire element therewithin having signing elements suspended therefrom and contained within said frame member.

2. A sign display support apparatus, as recited in claim 1 wherein said connector element is affixed to said fastening means.

3. A sign display support apparatus, as recited in claim 1 wherein said signing elements have electrical means for illumination thereof.

4. A sign display support apparatus as recited in claim 1 wherein said fastening means has means for affixing to said frame member.

5. A sign display support apparatus as recited in claim 4 wherein said means for affixing comprise threaded fasteners.

6. A sign display support apparatus as recited in claim 4 wherein said means for affixing comprises magnetic means.

7. A sign display support apparatus as recited in claim 1 wherein said stiffening element has an apex whereby said wire element is directed through said stiffening element.

* * * * *